US012369679B2

(12) United States Patent
Wexler

(10) Patent No.: US 12,369,679 B2
(45) Date of Patent: Jul. 29, 2025

(54) SHOE AND METHOD FOR PRODUCING A SHOE

(71) Applicant: Matthias Wexler, Rückersdorf (DE)

(72) Inventor: Matthias Wexler, Rückersdorf (DE)

(73) Assignee: Matthias Wexler, Rückersdorf (DE)

( * ) Notice: Subject to any disclaimer, the term of this patent is extended or adjusted under 35 U.S.C. 154(b) by 198 days.

(21) Appl. No.: 17/632,881

(22) PCT Filed: Aug. 6, 2020

(86) PCT No.: PCT/EP2020/072098

§ 371 (c)(1),
(2) Date: Feb. 4, 2022

(87) PCT Pub. No.: WO2021/023808

PCT Pub. Date: Feb. 11, 2021

(65) Prior Publication Data

US 2022/0264992 A1 Aug. 25, 2022

(30) Foreign Application Priority Data

Aug. 6, 2019 (EP) ..... 19190380

(51) Int. Cl.

| | |
|---|---|
| ***A43B 13/12*** | (2006.01) |
| ***A43B 9/02*** | (2006.01) |
| ***A43B 13/18*** | (2006.01) |
| ***A43B 13/36*** | (2006.01) |

(52) U.S. Cl.

CPC ..... *A43B 9/02* (2013.01); *A43B 13/12* (2013.01); *A43B 13/188* (2013.01); *A43B 13/36* (2013.01)

(58) Field of Classification Search

CPC ..... A43B 13/12; A43B 13/122; A43B 13/125; A43B 13/127; A43B 13/188

See application file for complete search history.

(56) References Cited

U.S. PATENT DOCUMENTS

| | | | |
|---|---|---|---|
| 2015/0289581 A1 | 10/2015 | Sussmann et al. | |
| 2017/0013912 A1 | 1/2017 | Marschall et al. | |
| 2017/0267850 A1* | 9/2017 | Baghdadi | C08L 23/0815 |

(Continued)

FOREIGN PATENT DOCUMENTS

| | | |
|---|---|---|
| DE | 202017101310 | 5/2017 |
| EP | 1854370 A1 | 11/2007 |
| EP | 2574251 | 4/2013 |

OTHER PUBLICATIONS

PCT International Search Report (with English translation) for corresponding Application No. PCT/EP2020/072098, mailed Sep. 7, 2020, 5 pages.

(Continued)

*Primary Examiner* — Ted Kavanaugh
(74) *Attorney, Agent, or Firm* — Dority & Manning, P.A.

(57) ABSTRACT

A shoe, comprising a sole part, which forms a sole portion of the shoe, and a shoe upper part, which forms an upper shoe portion of the shoe and can be fastened or is fastened to the sole part, wherein the sole part is produced at least in some portions, optionally completely, by foaming, at least in some portions, an injection-mouldable thermoplastic elastomer material, and the shoe upper part can be fastened or is fastened releasably, in particular separably by material type, to the sole part to form the shoe.

14 Claims, 3 Drawing Sheets

(56) References Cited

U.S. PATENT DOCUMENTS

Figure 1:
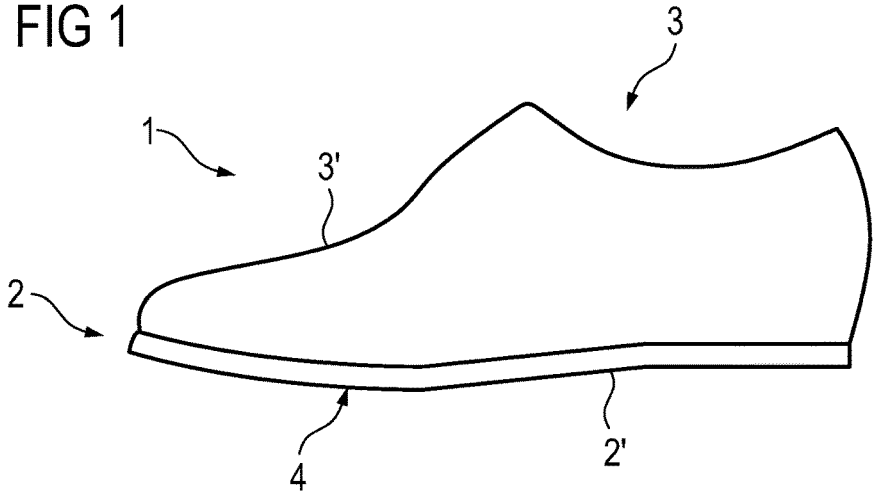

| | | | | |
|---|---|---|---|---|
| 2019/0276626 | A1* | 9/2019 | Baghdadi | C08G 63/672 |
| 2020/0100561 | A1* | 4/2020 | Montross | A43B 13/187 |
| 2020/0362154 | A1* | 11/2020 | Park | A43B 13/125 |

OTHER PUBLICATIONS

European Office Action for corresponding Application No. 19190380.6, dated Jul. 22, 2021, 6 pages.
European Office Action for corresponding Application No. 19190380.6, dated Apr. 20, 2022, 5 pages.

* cited by examiner

SHOE AND METHOD FOR PRODUCING A SHOE

This application is a National Phase Application of International Application No. PCT/EP2020/072098, filed Aug. 6, 2020, which, in turn, claims the right of priority of EP Patent Application No. 19190380.6, filed on Aug. 6, 2019, both of which are hereby incorporated herein by reference in their entirety for all purposes.

The invention relates to a shoe, comprising a sole part, which forms a sole portion of the shoe, and a shoe upper part, which forms an upper shoe portion of the shoe and can be fastened or is fastened to the sole part, and to a method for producing a shoe.

Shoes and methods for producing shoes are known in principle from the prior art in a large number of different forms.

However, known shoes and known methods for producing shoes are in need of improvement or further development as regards aspects of the increasingly more important requirement for sustainable handling of resources.

Against this background, there is a need for a shoe and a method for producing a shoe which permits (more) sustainable handling of resources in terms of both product and manufacture.

The object underlying the invention is to provide an improved shoe and an improved method for producing a shoe.

The object is achieved by a shoe and by a method disclosed herein. Also described are possible embodiments of the shoe and of the method.

A first aspect of the invention described herein relates to a shoe. The shoe comprises a sole part, which forms a sole portion of the shoe, and a shoe upper part, which forms an upper shoe portion of the shoe and can be fastened or is fastened to the sole part. The shoe typically thus has—at least from a functional point of view—a multi-part construction consisting of the sole part and the shoe upper part.

The shoe can in principle be any type of shoe; the shoe can accordingly be in the form of, for example, an open shoe, a half-open shoe or a closed shoe. The field of use of the shoe is also in principle open; the shoe can accordingly be in the form of, for example, a leisure shoe, a sports shoe or an evening shoe. The shoe can be a shoe for a woman or a man or for a child.

The sole part is typically formed by a sole part body or a sole part base body, or comprises at least one such body. The sole part, or a corresponding sole part (base) body, is typically the component of the shoe that has or defines a tread face, which faces the ground when the shoe is used for its intended purpose, and a face (foot support face) which faces a foot of a wearer when the shoe is used for its intended purpose.

The shoe upper part is typically formed by a shoe upper part body or a shoe upper part base body, or comprises at least one such body. The shoe upper part, or a corresponding shoe upper part (base) body, is typically the component of the shoe that has or defines a face which encloses a foot of a wearer at least in some portions, optionally completely, when the shoe is used for its intended purpose.

The sole part can have a single- or multi-part construction, that is to say in particular a single- or multi-ply construction. In an embodiment in which the sole part has a single-part construction, that is to say in particular a single-ply construction, the sole part can be in the form of, for example, a component that forms an outer sole, a middle sole and an inner sole. In a corresponding single-part embodiment, the sole part is thus typically produced with a tread face portion that forms a tread face of the shoe.

The tread face portion can be formed at least in some portions, optionally completely, with a three-dimensional surface structuring which forms a tread profile. Alternatively or in addition, the tread face portion can be formed with a surface structuring which influences the rolling behaviour of the shoe; such a structuring can be formed in particular by one or more rounded portions. In an analogous manner, a three-dimensional surface structuring can also be formed at least in some portions, optionally completely, in the region of an upper side of the sole part that forms a foot support face of the shoe or faces such a face; a corresponding surface structuring can positively influence the wear properties of the shoe.

In an embodiment in which the sole part has a multi-part construction, that is to say in particular a multi-ply construction, in the form of a component group comprising multiple components which form an outer sole or middle sole or inner sole.

The shoe upper part can also have a single- or multi-part construction, that is to say in particular a single- or multi-ply construction. The comments made in this respect in connection with the sole part apply analogously.

The sole part is formed or produced at least some portions, optionally completely, by foaming, at least in some portions, an injection-mouldable thermoplastic elastomer material (referred to hereinbelow as "TPE" for short). The sole part is thus generally a foamed injection-moulded part of a TPE which is produced within the context of an injection-moulding process that includes a foaming operation. The foamed and thus cellular structure of the sole part gives it particular structural properties, which result in particular wear properties of the shoe; the combination of the inherently comparatively soft TPE and the structure foamed at least in some portions, optionally completely, results, for example, in particular shock-absorbing or recovery properties of the sole part, which have a positive effect on the wear properties of the shoe.

The sole part, at least in some portions, optionally completely, can be in the form of an integral foam structure, or can have such a structure. A corresponding integral foam structure is typically distinguished in that it has a density which decreases, in particular continuously, from the outside to the inside. Integral foam structures thus typically have a cellular core and (almost) compact or solid edge regions. Via a corresponding integral foam structure, the sole part can thus generally be formed with structural properties which are different at least in some portions, in particular with mechanical properties which are different at least in some portions. A corresponding integral foam structure is thus expedient for the sole part in that both a tread face of the sole part, which faces the ground when the shoe is used for its intended purpose, and a face (foot support face) of the sole part which faces a foot of a wearer when the shoe is used for its intended purpose are of compact form and regions of the sole part lying therebetween, which thus provide, for example, particular shock-absorbing properties, are of (largely) cellular form. It is thereby also conceivable, as will be explained in greater detail hereinbelow, that a tread face of the sole part, which faces the ground when the shoe is used for its intended purpose, has different properties, that is to say in particular different wear, shock-absorbing, softness properties, than a face (foot support face) of the sole part which faces a foot of a wearer when the shoe is used for its intended purpose.

There come into consideration as the TPE in all embodiments in particular a thermoplastic polyamide elastomer (TPA), a thermoplastic copolyester elastomer (TPC), a thermoplastic olefin elastomer (TPO), a thermoplastic styrene elastomer (TPS), a thermoplastic urethane elastomer (TPU), a thermoplastic vulcanisate (TPV) or a mixture of the above-mentioned elastomers. The term "TPE" thus includes TPEs of a single type and also mixtures of chemically different TPEs. The sole part can thus be formed in particular from one of the above-mentioned TPEs.

The TPE can be an at least partially, optionally completely, recycled TPE. The TPE can thus be in particular a material mixture of recycled TPE and non-recycled TPE. In a corresponding material mixture, the amount by weight of recycled TPE can be in a range between 1 and 80%, in particular in a range between 1 and 70%, further in particular in a range between 1 and 60%, further in particular in a range between 1 and 50%, further in particular in a range between 1 and 40%, in particular in a range between 1 and 30%, further in particular in a range between 1 and 20%, further in particular in a range between 1 and 10%. The TPE can thus be a compound material containing recycled TPE.

The use of recycled TPE represents an important aspect of the possibility of sustainable handling of resources in terms of both product and manufacture.

Where recycled TPE is used, it can in particular be TPE that has been obtained by recycling a corresponding sole part produced from a TPE. Consequently, it is possible that components of the shoe, that is to say in particular the sole part, are recycled and used to produce a new shoe.

The sole part can be formed in particular by injecting a TPE loaded with at least one chemical and/or physical blowing agent into a moulding cavity of an injection-moulding tool and carrying out at least one measure for foaming, at least in some portions, the TPE loaded with the at least one blowing agent. In principle, the at least one measure for foaming, at least in some portions, the TPE loaded with the at least one blowing agent can be a chemical and/or a physical foaming operation.

There can accordingly be carried out as the measure for foaming, at least in some portions, the TPE loaded with the at least one blowing agent, for example, a lifting movement of at least one tool element, in particular a tool mould half, of the injection-moulding tool relative to at least one further tool element, in particular a further tool mould half, of the injection-moulding tool, which increases the volume of the moulding cavity of the injection-moulding tool compared with a completely closed state of the injection-moulding tool. The use of at least one tool element which makes a corresponding lifting movement possible is thereby conceivable.

As already indicated and as will become apparent hereinbelow, both the sole part and the shoe upper part can be components of the shoe which permit sustainable handling of resources in terms of both product and manufacture.

The sole part can—as already indicated in connection with the mentioned possible form of the sole part as an integral foam structure—be formed with different structural properties at least in some portions, in particular with different mechanical properties at least in some portions. The sole part can thus have different structural properties at least in some portions, that is to say in particular different mechanical properties at least in some portions. Different structural properties of the sole part result in particular from a different degree of foaming of the TPE used to produce the sole part. As mentioned, it is conceivable in particular that a tread face of the sole part, which faces the ground when the shoe is used for its intended purpose, has different structural properties, that is to say in particular different wear, shock-absorbing, softness properties, than a face (foot support face) which faces a foot of a wearer when the shoe is used for its intended purpose.

The degree of foaming of the TPE used to produce the sole part can generally vary between a minimum degree of foaming, that is to say typically a degree of foaming of 0%, to a maximum, in particular material- and/or process-specific, degree of foaming, that is to say in particular a degree of foaming of about 80%. Consequently, it is conceivable that the sole part (base) body has a first portion and at least one further portion, wherein the structural properties of the sole part (base) body in the first portion differ from the structural properties of the sole part (base) body in the at least one further portion. In other words, the sole part can be formed, for example, with a foam gradient. Consequently, sole parts with locally varying structural properties can be produced in a manner that is comparatively simple in terms of process technology, namely, for example, by varying the lifting movement which substantially influences the degree of foaming and/or by varying the blowing agent concentration.

In an exemplary embodiment, the sole part can be formed with a first degree of foaming in a first portion that forms a tread face of the shoe or faces a tread face of the shoe and with a second degree of foaming, which is different from the first degree of foaming, in a further portion that does not form a tread face of the shoe or faces away from a tread face of the shoe. In a first portion that forms a tread face of the shoe or faces a tread face of the shoe, for example, the sole part can thus be formed (substantially) compactly, that is to say with a degree of foaming of less than 5%, in particular a degree of foaming of 0%, and in a further portion that does not form a tread face of the shoe or faces away from a tread face of the shoe it can be formed with a degree of foaming of at least 5%. In this embodiment in which the degree of foaming is correspondingly reduced in comparison, the sole part can thus form a tread face, so that the application of a separate tread face element can optionally be dispensed with at least in some portions, optionally completely. The compact form of the sole part in the portion that forms a tread face of the shoe or faces a tread face of the shoe can be achieved, for example, by suitable mould temperature control, that is to say in particular mould temperature control near the surface.

Alternatively or in addition, first and further portions of correspondingly different forms can be formed in the longitudinal direction of the sole part. In this manner, different structural properties, that is to say in particular mechanical properties, such as, for example, shock-absorbing properties, can be formed, for example, in a first portion of the sole part which can be associated or is associated with a forefoot region, in a second portion of the sole part which can be associated or is associated with a mid-foot region, and in a third portion of the sole part which can be associated or is associated with a heel region.

The sole part can thus generally be formed in at least two different spatial directions, that is to say in particular in a horizontal and a vertical spatial direction, with structural portions which differ in their structural properties, that is to say in particular their mechanical properties.

The shoe upper part can be formed at least in some portions, optionally completely, from a textile material, in particular a natural textile material, preferably a biodegradable, that is to say in particular compostable, textile material. Corresponding textile materials can in particular be present in the form of textile sheet materials, that is to say in particular woven fabrics or knitted fabrics. The shoe upper part can thus be in the form of, for example, a sock-like or sock-shaped textile sheet material. Concrete examples of suitable textile materials are natural fibre materials of plant or animal origin, such as, for example, cotton, bast, reed, hemp, wool, etc. If the textile material is a biodegradable or compostable textile material, the shoe upper part can be disposed of biologically, for example by composting.

The shoe upper part is typically fastened releasably, in particular separably by material type, to the sole part and vice versa. The fastening of the shoe upper part to the sole part can thus be designed with regard to separability or separation by material type of the components of the shoe, that is to say in particular of the shoe upper part, the sole part and optionally any fastening materials for fastening the shoe upper part to the sole part, such as, for example, stitching materials, so that by releasing the fastening of the shoe upper part to the sole part, that is to say by detaching the shoe upper part from the sole part, separation of the shoe upper part from the sole part by material type is possible. Fastening the shoe upper part to the sole part separably by material type can also include fastening the shoe upper part to the sole part such that the fastening can be released in a damage-free or non-destructive manner.

Thus, in the case where it is necessary to replace the or a sole part, for example as a result of wear, a shoe upper part can be detached from the sole part and connected to a new sole part. In this manner, a shoe upper part can be reused to form a new shoe. Conversely, of course, in the case where it is necessary to replace the or a shoe upper part, for example as a result of wear, a sole part can be detached from the shoe upper part and connected to a new shoe upper part. In this manner, a sole part can be reused to form a new shoe.

In principle, a configuration of a shoe that is individual to a user can also be achieved in that, by releasing the fastening of the shoe upper part to the sole part of an existing shoe and by fastening the existing shoe upper part to a different sole part—the same of course also applies by fastening an existing sole part to a different shoe upper part—a new shoe can be configured.

The releasable fastening of the sole part to the shoe upper part and vice versa therefore constitutes an important aspect for the design of the shoe that is sustainable in terms of both product and manufacture.

The shoe upper part can be fastened to the sole part, for example, by at least one interlocking and/or friction-based type of fastening. There come into consideration, for example, latching, snap-fit, clamping or push-fit connections. Consequently, there can be formed on the sole part and/or on the shoe upper part at least one fastening interface which is adapted to cooperate with at least one corresponding fastening interface of the shoe upper part and/or sole part to form a fastening, in particular a releasable fastening, of the shoe upper part to the sole part. A corresponding fastening interface can in particular be formed integrally (monolithically) with the sole part.

A corresponding fastening interface can—in the case of an interlocking fastening—be in the form of an interlocking element. A corresponding interlocking element is adapted to cooperate with at least one corresponding interlocking element to form an interlocking fastening, in particular an interlocking fastening which can be released if required, of the shoe upper part to the sole part and vice versa. A corresponding interlocking element can be in the form of, for example, a receiving region for receiving a projection, in particular a projection with an undercut, or in the form of a projection, in particular a projection with an undercut. A corresponding receiving region can be in the form of, for example, a recess, opening, etc. in the sole part or in the shoe upper part.

A preferred embodiment provides that the shoe upper part is fastened to the sole part, and vice versa, by stitching or sewing, consequently by a stitched fastening. Stitching or sewing typically involves forming one or more stitches which fasten the shoe upper part to the sole part and vice versa. Fastening of the shoe upper part to the sole part by stitching is to be considered a preferred embodiment since it allows the or a shoe upper part to be fastened to the or a sole part in a manner that is stable but can be released and re-established comparatively easily if required.

The sole part can be formed with receiving regions, in particular recess-like or recess-shaped receiving regions, for receiving a yarn-like or yarn-shaped stitching material, that is to say generally a linear textile structure, such as, for example, a yarn. Corresponding receiving regions are typically formed in a tread face or a portion of the sole part (base) body that forms a tread face of the shoe or faces a tread face of the shoe. Corresponding receiving regions can be in the form of, for example, groove-like recesses in the sole part (base) body which extend linearly at least in some portions along a corresponding portion of the sole part (base) body. In this manner, a corresponding stitched fastening can be produced comparatively simply. Moreover, the stitching material is protected from direct contact with the ground during use of the shoe, so that damage to the stitching material caused during use of the shoe, for example by friction against the ground, can largely be prevented.

Equally, one or more passage regions, for example channel-like or channel-shaped passage regions, can be formed in the sole part (base) body for the passage of a stitching material through the sole part (base) body. Corresponding passage regions are typically so arranged and oriented that they allow a stitching material to be passed from a first fastening point or region, that is to say in particular a fastening point or region arranged or formed at an underside of the sole part that forms a tread face of the shoe or faces such a face, to a second fastening point or region, that is to say in particular a fastening point or region arranged or formed at an upper side of the sole part that forms a foot support face of the shoe or faces such a face. Corresponding passage regions can be arranged or oriented, for example, so that they extend vertically through the sole part (base) body.

The sole part can be formed with a fastening portion comprising one or more fastening interfaces for fastening the shoe upper part to the sole part. A fastening interface can correspond to an above-mentioned fastening point or region.

The fastening portion can be formed so that it extends at least in some portions, optionally completely, in the region of an upper side of the sole part that forms a foot support face of the shoe or faces such a face. The fastening portion can be formed so that it extends in particular at the edge at least in some portions, optionally completely, around the upper side of the sole part that forms a foot support face of the shoe or faces such a face. Fastening portions that extend continuously or discontinuously are in principle conceivable.

Conceivable embodiments provide, for example, that the at least one fastening portion is formed so that it extends, preferably at the edge, around the sole part, and/or that the at least one fastening portion is formed so that it extends at least in some portions, optionally completely, extensively in the region of the upper side of the sole part that forms a foot support face of the sole part or faces such a face. A correspondingly extensive form of the at least one fastening portion can be provided, for example, for fastening a shoe upper part in sock-like or sock-shaped form.

The fastening portion can in particular be in the form of a wall which extends at the edge at least in some portions, optionally completely, around an upper side of the sole part that forms a foot support face of the sole part or faces such a face and which is raised with respect to the foot support face of the sole part. The wall can be so configured that it (co-)delimits or (co-)defines a foot support face of the sole part. The wall can be formed integrally (monolithically) with the sole part (base) body. The wall can thus in particular be formed with the sole part (base) body in the injection-moulding process for producing the sole part. The wall can be, for example, strip-like or strip-shaped.

A corresponding fastening interface can in particular be in the form of an opening, in particular an eye-like or eye-shaped opening, in the wall, through which a stitching material is able to pass.

As an alternative or in addition to an interlocking and/or friction-based fastening, a substance-to-substance fastening of the shoe upper part to the sole part, for example by adhesive bonding, would be conceivable in principle—in particular with the proviso that the fastening, as mentioned, is releasable.

Instead of an embodiment in which the shoe upper part is fastened as a separate component to the sole part, it is also conceivable that the fastening of the shoe upper part to the sole part takes place within the context of an injection-moulding process. The fastening of the shoe upper part to the sole part can thus also take place in a (moulding) cavity of an injection-moulding tool. The sole part and the shoe upper part can thus be formed in a single- or multi-stage injection-moulding process. In this manner it is possible, for example but not exclusively, to produce shoes whose shoe upper parts are strip- or strap-like, that is to say, for example, sandals, flip-flops, etc.

The fastening of the shoe upper part to the sole part can thus take place by moulding an injection-mouldable thermoplastic material forming the shoe upper part onto the sole part or by moulding a TPE forming the sole part and loaded with at least one chemical and/or physical blowing agent onto the shoe upper part. The shoe upper part can accordingly be formed from an injection-mouldable thermoplastic material, which in particular is chemically similar to the TPE forming the sole part. Of course, it is conceivable that the sole part and the shoe upper part are formed from the same material.

In such an embodiment, the shoe upper part can be provided, for example, in the form of an insert part which can be inserted into a moulding cavity of an injection-moulding tool and can be inserted into a moulding cavity of an injection-moulding tool, and the sole part can be fastened to the shoe upper part by moulding the TPE forming the sole part and loaded with at least one chemical and/or physical blowing agent onto the shoe upper part. Of course, a reverse procedure is also conceivable, so that the sole part can be provided, for example, in the form of an insert part which can be inserted into a moulding cavity of an injection-moulding tool and can be inserted into a moulding cavity of an injection-moulding tool, and the shoe upper part can be fastened to the sole part by moulding onto the sole part.

In this context it should also be mentioned that, in a conceivable embodiment, a separate tread face element forming an optionally profiled tread face of the shoe can be provided in the form of an insert part which can be inserted into a moulding cavity of an injection-moulding tool and can be inserted into a moulding cavity of an injection-moulding tool, and the sole part can be fastened to the insert part by moulding the TPE forming the sole part and loaded with at least one chemical and/or physical blowing agent onto the insert part.

For all embodiments, the sole part can be formed with a surface configuration, in particular a surface configuration modelled on a footbed, in the region of an upper side that forms a foot support face or faces such a face. The sole part can thus be designed in the region of its upper side at least in some portions, optionally completely, with a surface configuration, that is to say in particular a footbed, which is ergonomic and supports the foot.

In connection with a multi-part or multi-ply construction of the sole part is in particular a configuration of the sole part with a compact outer sole of a TPE or TPU and a middle sole of a TPE or TPU that is foamed at least in some portions, optionally completely. The middle sole can be formed at least in some portions, optionally completely, with an integral foam structure. There can further be arranged or formed on the middle sole an inner sole forming a foot support face of a wearer of the shoe. The outer sole and the middle sole can be connected together, for example, by a substance-to-substance connection, in particular by adhesive bonding and/or welding. The outer sole and the middle sole can be formed from the same TPE, in particular the same TPU, or chemically similar TPEs or TPUs; the form of the outer sole and middle sole from the same TPE or TPU or chemically similar TPEs or TPUs can be expedient in particular with regard to an adhesively bonded or welded connection thereof. The connection of the outer sole and middle sole can be such that separation thereof by material type, for example mechanically, that is to say in particular by cutting, is possible.

In the above-mentioned configuration of the sole part with a compact outer sole of a TPE or TPU and a middle sole of a TPE or TPU that is foamed at least in some portions, optionally completely, the shoe upper part can be connected to the middle sole by an interlocking and/or friction-based connection, in particular by stitching or sewing. Alternatively or in addition, the shoe upper part can be connected to the middle sole by adhesive bonding.

The outer sole in the above-mentioned configuration of the sole part with a compact outer sole of TPE or TPU and a middle sole of a TPE or TPU that is foamed at least in some portions, optionally completely, can further be provided with a receiving region, in particular formed by an optionally trough-like or trough-shaped depression, for receiving the middle sole. The middle sole can be provided with an engagement portion, in particular formed by a projection, which is adapted to engage into the receiving region in the assembled state of the shoe.

A second aspect of the invention described herein relates to a sole part for a shoe according to the first aspect of the invention described herein. The sole part is distinguished in particular in that it is produced at least in some portions, optionally completely, by foaming, at least in some portions, an injection-mouldable thermoplastic elastomer material.

All comments made in connection with the shoe according to the first aspect of the invention apply analogously to the sole part.

A third aspect of the invention described herein relates to a method for producing a shoe, comprising a sole part, which forms a sole portion of the shoe, and a shoe upper part, which forms an upper shoe portion of the shoe and can be fastened or is fastened to the sole part. The method is suitable in particular for producing a shoe according to the first aspect of the invention.

The method comprises the steps: producing or providing a sole part, wherein the sole part is produced at least in some portions, optionally completely, by foaming, at least in some portions, an injection-mouldable thermoplastic elastomer material; producing or providing a shoe upper part; and fastening the shoe upper part to the sole part to form the shoe.

All comments made in connection with the shoe according to the first aspect of the invention apply analogously to the method.

Figure 6:
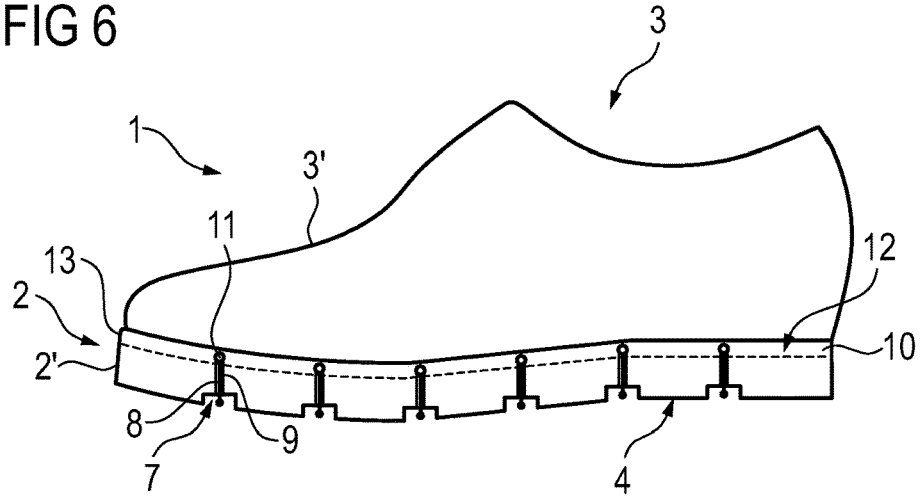
Figure 7:
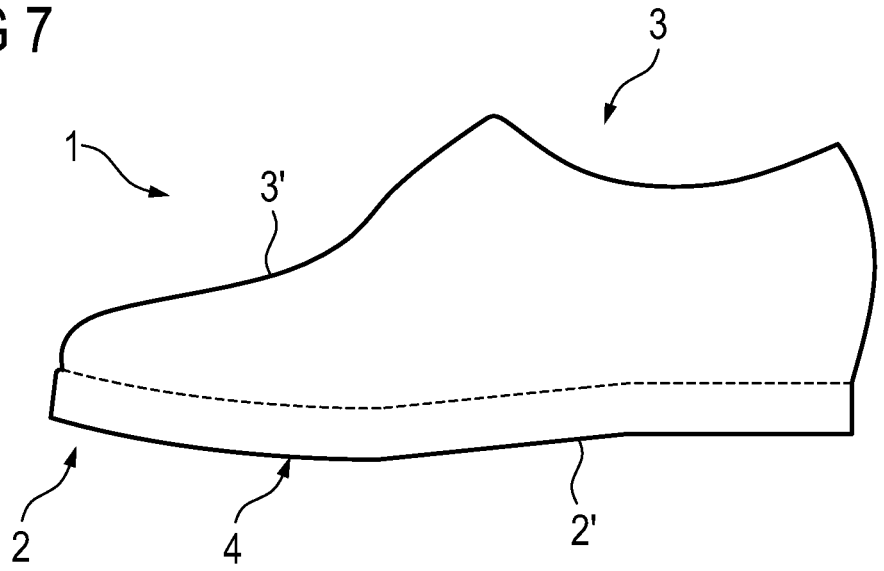
Figure 8:
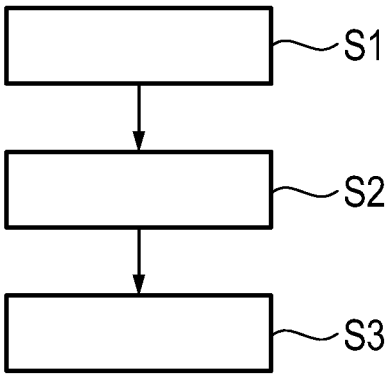

Individual aspects and features of the invention are explained by means of exemplary embodiments in association with the drawings, in which:

FIGS. 1-7 each show a schematic diagram of a shoe according to an exemplary embodiment; and FIG. 8 shows a schematic diagram of a flow chart of a method for producing a shoe according to an exemplary embodiment.

FIG. 1 shows a schematic diagram of a shoe 1 according to an exemplary embodiment.

As can be seen, the shoe 1 comprises a sole part 2, which forms a sole portion of the shoe 1, and a shoe upper part 3, which forms an upper shoe portion of the shoe 1 and can be fastened or is fastened to the sole part 2. The shoe thus typically has—at least from a functional point of view—a multi-part construction consisting of the sole part 2 and the shoe upper part 3.

The shoe 1 can in principle be any type of shoe; the shoe 1 can accordingly be in the form of, for example, an open shoe, a half-open shoe or a closed shoe. The field of use of the shoe 1 is also in principle open; the shoe 1 can accordingly be in the form of, for example, a leisure shoe, a sports shoe or an evening shoe. The shoe 1 can also be a shoe for a woman or a man or for a child.

The sole part 2 is typically formed by a sole part body or a sole part base body 2', or comprises at least one such body. The sole part 2, or a corresponding sole part (base) body 2', is typically the component of the shoe 1 that has or defines a tread face, which faces the ground when the shoe 1 is used for its intended purpose, and a face (foot support face) which faces a foot of a wearer when the shoe 1 is used for its intended purpose.

The shoe upper part 3 is typically formed by a shoe upper part body or a shoe upper part base body 3', or comprises at least one such body. The shoe upper part 3, or a corresponding shoe upper part (base) body 3', is typically the component of the shoe 1 that has or defines a face which encloses a foot of a wearer at least in some portions, optionally completely, when the shoe 1 is used for its intended purpose.

The sole part 2 can have a single- or multi-part construction, that is to say in particular a single- or multi-ply construction. In an exemplary embodiment as shown purely by way of example in FIG. 1, in which the sole part 2 has a single-part construction, that is to say in particular a single-ply construction, the sole part 2 can be in the form of, for example, a component that forms an outer sole, a middle sole and an inner sole. In a corresponding single-part exemplary embodiment, the sole part 2 is thus typically produced with a tread face portion 4 that forms a tread face of the shoe 1.

The tread face portion 4 can be formed at least in some portions, optionally completely, with a three-dimensional surface structuring which forms a tread profile. Alternatively or in addition, the tread face portion 4 can be formed with a surface structuring which influences the rolling behaviour of the shoe 1; such a structuring can be formed in particular by one or more rounded portions. In an analogous manner, a three-dimensional structuring can also be formed at least in some portions, optionally completely, in the region of an upper side of the sole part 2 that forms a foot support face of the shoe 1 or faces such a face; a corresponding surface structuring can positively influence the wear properties of the shoe 1.

Figure 2:
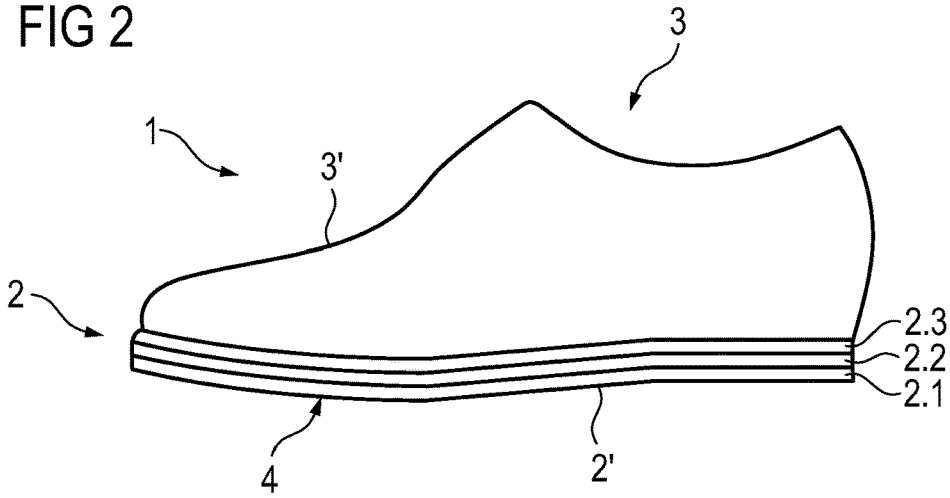

In an exemplary embodiment as shown purely by way of example in FIG. 2, in which the sole part 2 has a multi-part construction, that is to say in particular a multi-ply construction, the sole part 2 can be in the form of a component group comprising multiple components 2.1-2.3 which form an outer sole or middle sole or inner sole.

Although not shown in the figures, the shoe upper part 3 can also have a single- or multi-part construction, that is to say in particular a single- or multi-ply construction. The comments made in this respect in connection with the sole part 2 apply analogously.

In all exemplary embodiments, the sole part 2 is formed or produced at least in some portions, optionally completely, by foaming, at least in some portions, an injection-mouldable thermoplastic elastomer material (referred to hereinbelow as "TPE" for short). The sole part 2 is thus generally a foamed injection-moulded part of a TPE which is produced within the context of an injection-moulding process that includes a foaming operation. The foamed and thus cellular structure of the sole part 2 gives it particular structural properties, which result in particular wear properties of the shoe 1; the combination of the inherently comparatively soft TPE and the structure foamed at least in some portions, optionally completely, results, for example, in particular shock- absorbing or recovery properties of the sole part 2, which have a positive effect on the wear properties of the shoe 1.

The sole part 2, at least in some portions, optionally completely, can be in the form of an integral foam structure, or can have such a structure. A corresponding integral foam structure is typically distinguished in that it has a density which decreases, in particular continuously, from the outside to the inside. Integral foam structures thus typically have a cellular core and (almost) compact or solid edge regions. Integral foam structures thus typically have a cellular core and (almost) compact or solid edge regions. A corresponding integral foam structure is expedient for the sole part 2 in that both a tread face of the sole part 2, which faces the ground when the shoe 1 is used for its intended purpose, and a face (foot support face) of the sole part 2 which faces a foot of a wearer when the shoe 1 is used for its intended purpose are of compact form and regions of the sole part 3 lying therebetween, which thus provide, for example, particular shock-absorbing properties, are of (largely) cellular form. It is thereby also conceivable, as will be explained in greater detail hereinbelow, that a tread face of the sole part 2, which faces the ground when the shoe 1 is used for its intended purpose, has different properties, that is to say in particular different wear, shock-absorbing, softness properties, than a face (foot support face) of the sole part 2 which faces a foot of a wearer when the shoe 1 is used for its intended purpose.

There come into consideration as the TPE in all exemplary embodiments in particular a thermoplastic polyamide elastomer (TPA), a thermoplastic copolyester elastomer (TPC), a thermoplastic olefin elastomer (TPO), a thermoplastic styrene elastomer (TPS), a thermoplastic urethane elastomer (TPU), a thermoplastic vulcanisate (TPV) or a mixture of the above-mentioned elastomers. The term "TPE" thus includes TPEs of a single type and also mixtures of chemically different TPEs. The sole part 2 can thus be formed in particular from one of the above-mentioned TPEs.

The TPE can be an at least partially, optionally completely, recycled TPE. The TPE can thus be in particular a material mixture of recycled TPE and non-recycled TPE. In a corresponding material mixture, the amount by weight of recycled TPE can be in a range between 1 and 80%, in particular in a range between 1 and 70%, further in particular in a range between 1 and 60%, further in particular in a range between 1 and 50%, further in particular in a range between 1 and 40%, in particular in a range between 1 and 30%, further in particular in a range between 1 and 20%, further in particular in a range between 1 and 10%.

The use of recycled TPE represents an important aspect of the possibility of sustainable handling of resources in terms of both product and manufacture.

Where recycled TPE is used, it can in particular be TPE that has been obtained by recycling a corresponding sole part 2 produced from a TPE. Consequently, it is possible that components of the shoe 1, that is to say in particular the sole part 2, are recycled and used to produce a new shoe 1.

The sole part 2 can be formed by injecting a TPE loaded with at least one chemical and/or physical blowing agent into a moulding cavity of an injection-moulding tool and carrying out at least one measure for foaming, at least in some portions, the TPE loaded with the at least one blowing agent. In principle, the at least one measure for foaming, at least in some portions, the TPE loaded with the at least one blowing agent can be a chemical and/or a physical foaming operation.

There can accordingly be carried out as the measure for foaming, at least in some portions, the TPE loaded with the at least one blowing agent, for example, a lifting movement of at least one tool element, in particular a tool mould half, of the injection-moulding tool relative to at least one further tool element, in particular a further tool mould half, of the injection-moulding tool, which increases the volume of the moulding cavity of the injection-moulding tool compared with a completely closed state of the injection-moulding tool. The use of at least one tool element which makes a corresponding lifting movement possible is thereby conceivable.

The sole part 2 can—as will be explained hereinbelow in connection with the exemplary embodiments shown in FIG. 3, 4—be formed with different structural properties at least in some portions, in particular with different mechanical properties at least in some portions. The sole part 2 can thus have different structural properties at least in some portions, that is to say in particular different mechanical properties at least in some portions. Different structural properties of the sole part 2 result in particular from a different degree of foaming of the TPE used to produce the sole part 2. As mentioned, it is conceivable in particular that a tread face of the sole part 2, which faces the ground when the shoe 1 is used for its intended purpose, has different structural properties, that is to say in particular different wear, shock-absorbing, softness properties, than a face (foot support face) which faces a foot of a wearer when the shoe 1 is used for its intended purpose.

The degree of foaming of the TPE used to produce the sole part 2 can generally vary between a minimum degree of foaming, that is to say typically a degree of foaming of 0%, to a maximum, in particular material- and/or process-specific, degree of foaming, that is to say in particular a degree of foaming of about 80%. Consequently, it is conceivable that the sole part (base) body 2' has a first portion 2.4 and at least one further portion 2.5, wherein the structural properties of the sole part (base) body 2' in the first portion 2.4 differ from the structural properties of the sole part (base) body 2' in the at least one further portion 2.5. In other words, the sole part 2 can be formed, for example, with a foam gradient. Consequently, sole parts 2 with locally varying structural properties can be produced in a manner that is comparatively simple in terms of process technology, namely, for example, by varying the lifting movement which substantially influences the degree of foaming and/or by varying the blowing agent concentration.

Figure 3:
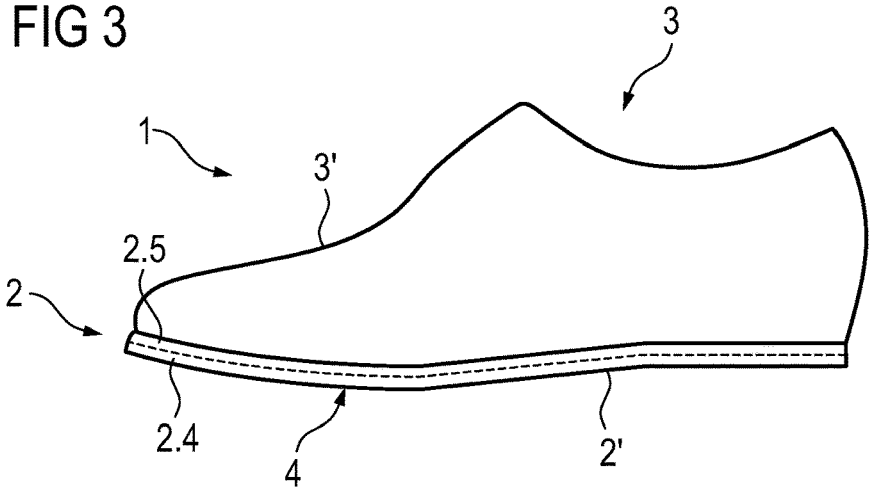

In the exemplary embodiment shown purely by way of example in FIG. 3, the sole part 2 is formed with a first degree of foaming in a first portion that forms a tread face of the shoe 1 or faces a tread face of the shoe 1 and with a second degree of foaming, which is different from the first degree of foaming, in a further portion that does not form a tread face of the shoe 1 or faces away from a tread face of the shoe 1. In a first portion that forms a tread face of the shoe 1 or faces a tread face of the shoe 1, for example, the sole part 2 can thus be formed (substantially) compactly, that is to say with a degree of foaming of less than 5%, in particular a degree of foaming of 0%, and in a further portion that does not form a tread face of the shoe 1 or faces away from a tread face of the shoe 1 it can be formed with a degree of foaming of at least 5%. In this embodiment in which the degree of foaming is correspondingly reduced in comparison, the sole part 2 can thus form a tread face, so that the application of a separate tread face element can optionally be dispensed with at least in some portions, optionally completely. The compact form of the sole part 2 in the portion that forms a tread face 1 of the shoe or faces a tread face of the shoe 1 can be achieved, for example, by suitable mould temperature control, that is to say in particular mould temperature control near the surface.

Figure 4:
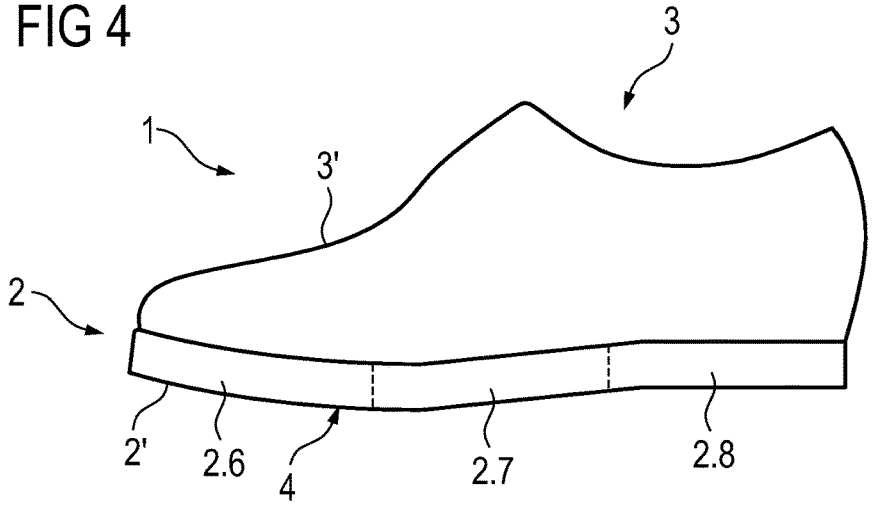

Alternatively or in addition—as is shown purely by way of example in the exemplary embodiment according to FIG. 4—first and further portions 2.6-2.8 of correspondingly different forms can be formed in the longitudinal direction of the sole part 2. In this manner, different structural properties, that is to say in particular mechanical properties, such as, for example, shock-absorbing properties, can be formed, for example, in a first portion 2.6 of the sole part 2 which can be associated or is associated with a forefoot region, in a second portion 2.7 of the sole part which can be associated or is associated with a mid-foot region, and in a third portion 2.8 of the sole part which can be associated or is associated with a heel region.

The sole part 2 can thus generally be formed in at least two different spatial directions, that is to say in particular in a horizontal and a vertical spatial direction, with structural portions 2.4-2.8 which differ in their structural properties, that is to say in particular their mechanical properties.

In all exemplary embodiments, the shoe upper part 3 can be formed at least in some portions, optionally completely, from a textile material, in particular a natural textile material, preferably a biodegradable, that is to say in particular compostable, textile material. Corresponding textile materials can in particular be in the form of textile sheet materials, that is to say in particular woven fabrics or knitted fabrics. The shoe upper part 3 can thus be in the form of, for example, a sock-like or sock-shaped textile sheet material. Concrete examples of suitable textile materials are natural fibre materials of plant or animal origin, such as, for example, cotton, bast, reed, hemp, wool, etc. If the textile material is a biodegradable or compostable textile material, the shoe upper part can be disposed of biologically, for example by composting.

In all exemplary embodiments, the shoe upper part 3 can be fastened releasably, in particular separably by material type, to the sole part 2 and vice versa. The fastening of the shoe upper part 3 to the sole part 2 can thus be designed with regard to separability or separation by material type of the components of the shoe 1, that is to say in particular of the shoe upper part 3, the sole part 2 and optionally any fastening materials for fastening the shoe upper part 3 to the sole part 2, such as, for example, stitching materials, so that by releasing the fastening of the shoe upper part 3 to the sole part 2, that is to say by detaching the shoe upper part 3 from the sole part 2, separation of the shoe upper part 3 from the sole part 2 by material type is possible. Fastening the shoe upper part 3 to the sole part 2 separably by material type can also include fastening the shoe upper part 3 to the sole part 2 such that the fastening can be released in a damage-free or non-destructive manner.

Thus, in the case where it is necessary to replace the or a sole part 2, for example as a result of wear, a shoe upper part 3 can be detached from the sole part 2 and connected to a new sole part 2. In this manner, a shoe upper part 3 can be reused to form a new shoe 1. Conversely, of course, in the case where it is necessary to replace the or a shoe upper part 3, for example as a result of wear, a sole part 2 can be detached from the shoe upper part 3 and connected to a new shoe upper part 3. In this manner, a sole part 3 can be reused to form a new shoe 1.

In principle, a configuration of a shoe 1 that is individual to a user can also be achieved in that, by releasing the fastening of the shoe upper part 3 to the sole part 2 of an existing shoe 1 and by fastening the existing shoe upper part 3 to a different sole part 2—the same of course also applies by fastening an existing sole part 2 to a different shoe upper part 3—a new shoe 1 can be configured.

The shoe upper part 3 can be fastened to the sole part 2 by at least one interlocking and/or friction-based type of fastening. There come into consideration, for example, latching, snap-fit, clamping or push-fit connections. Consequently, there can be formed on the sole part 2 and/or on the shoe upper part 3 at least one fastening interface 5, 6 which is adapted to cooperate with at least one corresponding fastening interface of the shoe upper part 3 and/or sole part 2 to form a fastening, in particular a releasable fastening, of the shoe upper part 3 to the sole part 2. A corresponding fastening interface can in particular be formed integrally (monolithically) with the sole part 2.

Figure 5:
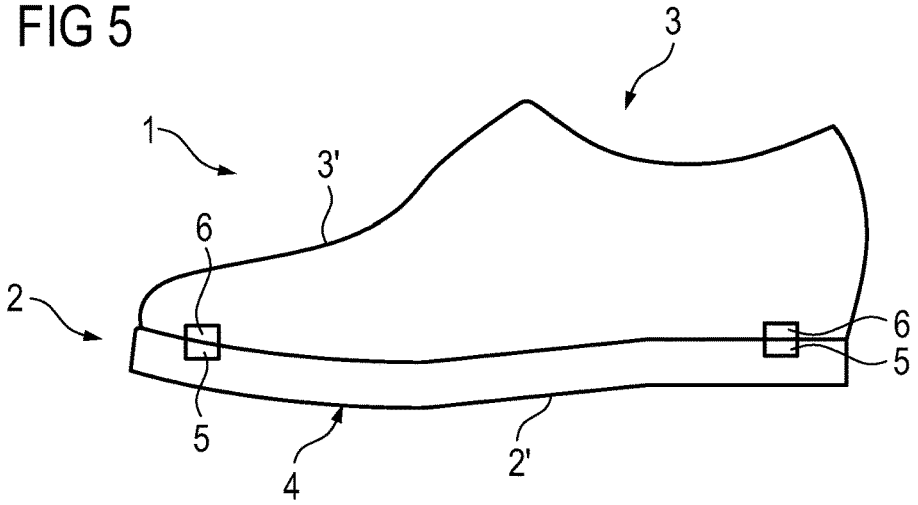

As is shown purely by way of example in the exemplary embodiment according to FIG. 5, a corresponding fastening interface 5 can—in the case of an interlocking fastening—be in the form of an interlocking element. A corresponding interlocking element is adapted to cooperate with at least one corresponding interlocking element to form an interlocking fastening, in particular an interlocking fastening which can be released if required, of the shoe upper part 3 to the sole part 2 and vice versa. A corresponding interlocking element can be in the form of, for example, a receiving region for receiving a projection, in particular a projection with an undercut, or in the form of a projection, in particular a projection with an undercut. A corresponding receiving region can be in the form of, for example, a recess, opening, etc. in the sole part 2 or in the shoe upper part 3.

A further exemplary embodiment shown purely by way of example in FIG. 6 provides that the shoe upper part 3 is fastened to the sole part 2, and vice versa, by stitching or sewing, consequently by a stitched fastening. Stitching or sewing typically involves forming one or more stitches which fasten the shoe upper part 3 to the sole part 2 and vice versa. Fastening of the shoe upper part 3 to the sole part 2 by stitching is to be considered a preferred exemplary embodiment since it allows the or a shoe upper part 3 to be fastened to the or a sole part 2 in a manner that is stable but can be released and re-established comparatively easily if required.

The sole part 2 can be formed with receiving regions 7, in particular recess-like or recess-shaped receiving regions, for receiving a yarn-like or yarn-shaped stitching material 8, that is to say generally a linear textile structure, such as, for example, a yarn. Corresponding receiving regions 7 are typically formed in a tread face or a portion of the sole part (base) body 2' that forms a tread face of the shoe 1 or faces a tread face of the shoe 1. Corresponding receiving regions 7 can be in the form of, for example, groove-like recesses in the sole part (base) body 2' which extend linearly at least in some portions along a corresponding portion of the sole part (base) body 2'. In this manner, a corresponding stitched fastening can be produced comparatively simply. Moreover, the stitching material 8 is protected from direct contact with the ground during use of the shoe 1, so that damage to the stitching material 8 caused during use of the shoe 1, for example by friction against the ground, can largely be prevented.

Equally—as is likewise shown purely by way of example in FIG. 6—one or more passage regions 9, for example channel-like or channel-shaped passage regions, can be formed in the sole part (base) body 2' for the passage of a stitching material 8 through the sole part (base) body 2'. Corresponding passage regions 9 are typically so arranged and oriented that they allow a stitching material 8 to be passed from a first fastening point or region, that is to say in particular a fastening point or region arranged or formed at an underside of the sole part 2 that forms a tread face of the shoe 1 or faces such a face, to a second fastening point or region, that is to say in particular a fastening point or region arranged or formed at an upper side of the sole part 2 that forms a foot support face 12 of the sole part 2 or faces such a face. Corresponding passage regions 9 can be arranged or oriented, for example, so that they extend vertically through the sole part (base) body 3'.

It is further apparent with reference to FIG. 6 that the sole part 2 can be formed with a fastening portion 10 comprising one or more fastening interfaces 11 for fastening the shoe upper part 3 to the sole part 2. A fastening interface 11 can correspond to an above-mentioned fastening point or region.

The fastening portion 10 can be formed so that it extends in the region of an upper side of the sole part 2 that forms a foot support face 12 of the sole part 2 or faces such a face. The fastening portion 10 can be formed so that it extends in particular at the edge around the upper side of the sole part 2 that forms a foot support face 12 of the sole part 2 or faces such a face. Fastening portions 10 that extend continuously or discontinuously are in principle conceivable.

Conceivable exemplary embodiments provide—as is shown by way of example in FIG. 6—that the fastening portion 10 is formed so that it extends, preferably at the edge, around the sole part 2. The fastening portion 10 can thus be in the form of a wall 13 which extends at the edge at least in some portions, optionally completely, around an upper side of the sole part 2 that forms a foot support face 12 of the sole part 2 or faces such a face and which is raised with respect to the foot support face 12 of the sole part 2. The wall 13 can be so configured that it (co-)delimits or (co-)

defines a foot support face 12 of the sole part 2. The wall 13 can be formed integrally (monolithically) with the sole part (base) body 2'. The wall 13 can thus in particular be formed with the sole part (base) body 2' in the injection-moulding process for producing the sole part 2. The wall 13 can be, for example, strip-like or strip-shaped.

Alternatively or in addition—although not shown in FIG. 6—the fastening portion 10 can be formed so that it extends at least in some portions, optionally completely, extensively in the region of the upper side of the sole part 2 that forms a foot support face of the sole part 2 or faces such a face. A correspondingly extensive form of the fastening portion 10 can be provided, for example, for fastening a shoe upper part 3 of sock-like or sock-shaped form.

It is likewise indicated purely schematically by way of example in FIG. 6 that a corresponding fastening interface 11 can in particular be in the form of an opening, in particular an eye-like or eye-shaped opening, in the wall 13, through which a stitching material 8 is able to pass.

As an alternative or in addition to an interlocking and/or friction-based fastening, a substance-to-substance fastening of the shoe upper part 3 to the sole part 2, for example by adhesive bonding, would be conceivable in principle—in particular with the proviso that the fastening, as mentioned, is releasable.

FIG. 7 shows an exemplary embodiment in which the fastening of the shoe upper part 3 to the sole part 2 takes place within the context of an injection-moulding process. The fastening of the shoe upper part 3 to the sole part 2 can thus also take place in a (moulding) cavity of an injection-moulding tool. The sole part 2 and the shoe upper part 3 can thus be formed in a single- or multi-stage injection-moulding process. In this manner it is possible, for example but not exclusively, to produce shoes 1 whose shoe upper parts 3 are strip- or strap-like, that is to say, for example, sandals, flip-flops, etc.

The fastening of the shoe upper part 3 to the sole part 2 can thus take place by moulding an injection-mouldable thermoplastic material forming the shoe upper part 3 onto the sole part 2 or by moulding a TPE forming the sole part 2 and loaded with at least one chemical and/or physical blowing agent onto the shoe upper part 3. The shoe upper part 3 can accordingly be formed from an injection-mouldable thermoplastic material, which in particular is chemically similar to the TPE forming the sole part 2. Of course, it is conceivable that the sole part 2 and the shoe upper part 3 are formed from the same material.

In such an exemplary embodiment, the shoe upper part 3 can be provided, for example, in the form of an insert part which can be inserted into a moulding cavity of an injection-moulding tool and can be inserted into a moulding cavity of an injection-moulding tool, and the sole part 2 can be fastened to the shoe upper part 3 by moulding the TPE forming the sole part 2 and loaded with at least one chemical and/or physical blowing agent onto the shoe upper part 3. Of course, a reverse procedure is also conceivable, so that the sole part 2 can be provided, for example, in the form of an insert part which can be inserted into a moulding cavity of an injection-moulding tool and can be inserted into a moulding cavity of an injection-moulding tool, and the shoe upper part 3 can be fastened to the sole part 2 by moulding onto the sole part 2.

In this context it should also be mentioned that, in a conceivable exemplary embodiment, a separate tread face element forming an optionally profiled tread face of the shoe 1 can be provided in the form of an insert part which can be inserted into a moulding cavity of an injection-moulding tool and can be inserted into a moulding cavity of an injection-moulding tool, and the sole part 2 can be fastened to the insert part by moulding the TPE forming the sole part 2 and loaded with at least one chemical and/or physical blowing agent onto the insert part.

For all embodiments, the sole part 2 can be formed with a surface configuration, in particular a surface configuration modelled on a footbed, in the region of an upper side that forms a foot support face 12 of the sole part 2 or faces such a face. The sole part 2 can thus be designed in the region of its upper side at least in some portions, optionally completely, with a surface configuration, that is to say in particular a footbed, which is ergonomic and supports the foot.

FIG. 8 shows a schematic diagram of a flow chart of a method for producing a shoe 1 according to an exemplary embodiment.

The method comprises the following basic steps:

- producing or providing a sole part, wherein the sole part is produced at least in some portions, optionally completely, by foaming, at least in some portions, an injection-mouldable thermoplastic elastomer material (step S1);
- producing or providing a shoe upper part (step S2); and
- fastening the shoe upper part to the sole part to form the shoe (step S3).

Individual, multiple or all the aspects described in connection with a specific exemplary embodiment can be combined with individual, multiple or all aspects described in connection with at least one further exemplary embodiment.

The invention claimed is:

1. A shoe, comprising a sole part, which forms a sole portion of the shoe and which comprises a tread face, which faces the ground when the shoe is used for its intended purpose, and a shoe upper part, which forms an upper shoe portion of the shoe and is fastened to the sole part, wherein the sole part is produced by foaming, an injection-moldable thermoplastic elastomer material, wherein the sole part comprises an integral foam structure of a thermoplastic elastomer material, wherein the integral foam structure of the thermoplastic elastomer material comprises a density which decreases from the outside to the inside, and the shoe upper part is fastened releasably to the sole part to form the shoe.

2. The shoe according to claim 1, wherein the sole part, at least in some portions, is in the form of the integral foam structure.

3. The shoe according to claim 1, wherein the sole part is produced with structural properties which differ at least in some portions.

4. The shoe according to claim 1, wherein the sole part is produced with different structural properties in a first portion that forms a tread surface of the shoe or faces a tread surface of the shoe in a further portion that does not form a tread surface of the shoe or faces away from a tread surface of the shoe.

5. The shoe according to claim 4, wherein the sole part is produced with a first degree of foaming in a first portion that forms a tread surface of the sole part or faces a tread surface of the shoe and with a second degree of foaming, which is different from the first degree of foaming, in a further portion that does not form a tread surface of the shoe or faces away from a tread surface of the shoe.

6. The shoe according to claim 1, wherein the shoe upper part is fastened to the sole part by at least one interlocking and/or friction-based type of fastening.

7. The shoe according to claim 1, wherein the shoe upper part is fastened to the sole part by stitching.

8. The shoe according to claim 1, wherein the sole part is produced with receiving regions, in particular recess-like or recess-shaped receiving regions, for receiving a stitching material.

9. The shoe according to claim 1, wherein the sole part is produced with at least one fastening portion comprising one or more fastening interfaces.

10. The shoe according to claim 9, wherein the at least one fastening portion is formed so that it extends at least in some portions in the region of an upper side of the sole part that forms a foot support surface of the sole part or faces such a surface, wherein the at least one fastening portion is formed so that it extends, preferably at the edge, around the sole part, and/or the at least one fastening portion is formed so that it extends at least in some portions flatly in the region of the upper side of the sole part that forms a foot support surface of the sole part or faces such a surface.

11. The shoe according to claim 9, wherein a fastening interface is in the form of an opening through which a stitching material passes.

12. The shoe according to claim 1, wherein the sole part is produced at least partially from a recycled thermoplastic elastomer material.

13. The shoe according to claim 1, wherein the shoe upper part is produced at least in some portions from a textile material.

14. The sole part for a shoe according to claim 1, wherein the sole part is produced at least in some portions by foaming, at least in some portions, an injection-moldable thermoplastic elastomer material.

* * * * *